United States Patent [19]

Fischer

[11] Patent Number: 4,634,929

[45] Date of Patent: Jan. 6, 1987

[54] BROADBAND MULTIPACTOR DEVICE

[75] Inventor: Paul Fischer, Oakhurst, N.J.

[73] Assignee: The United States of America as represented by the Secretary of the Army, Washington, D.C.

[21] Appl. No.: 583,920

[22] Filed: Feb. 27, 1984

[51] Int. Cl.[4] ..... H01J 25/10

[52] U.S. Cl. ..... 315/5.39; 313/103 R; 315/5.11; 315/5.14; 315/5.43; 333/99 MP

[58] Field of Search ..... 315/5.11, 5.12, 5.14, 315/5.43, 5.39, 39; 333/99 MP; 313/103

[56] References Cited

U.S. PATENT DOCUMENTS

| | | | |
|---|---|---|---|
| 2,591,322 | 4/1952 | Warnecke | 315/5.12 |
| 2,912,620 | 11/1959 | Mullett | 315/5.12 |
| 3,195,007 | 7/1965 | Watson et al. | 315/5.43 |
| 3,244,922 | 4/1966 | Wolfgang . | |
| 3,278,793 | 10/1966 | Dehn | 315/5.14 |
| 3,312,857 | 4/1967 | Farnsworth | 315/5.12 X |
| 3,457,490 | 7/1969 | Keenan | 333/99 MP |
| 4,199,738 | 4/1980 | Carlisle et al. | 333/99 MP |
| 4,527,137 | 7/1985 | Hartley | 333/99 MP |

OTHER PUBLICATIONS

Journal of Applied Physics, A. J. Hatch, et al., vol. 25, No. 4 Apr. 1954, pp. 417–423, "The Secondary Electron Resonance . . . ".

IEEE Transactions on Nuclear Science, vol. NS-26, No. 3, Jun. 1979, pp. 4230–4232, W. J. Gallagher, "The Multipactor Effect".

Proceedings of the IEEE, W. J. Gallagher, Jan. 1969, pp. 94–95, "The Multipactor Electron Gun".

IRE Transactions Microwave Theory and Techniques, Oct. 1955, pp. 20–29, Samuel Hopfer, "The Design of Ridged Waveguides".

*Primary Examiner*—Saxfield Chatmon

*Attorney, Agent, or Firm*—Anthony T. Lane; Jeremiah G. Murray; Maurice W. Ryan

[57] ABSTRACT

A plurality of contiguous cavity pairs of multipactor input and output cavities respectively formed in two opposing ridge waveguide sections and which are mutually separated by an acceleration drift region of relatively high DC electric field strength. Both waveguide sections include means such as an RF window at one end for coupling RF power in and out of the sections while the other end is suitably terminated and additionally provides the structure which can be placed under a vacuum to properly function. The cavity pairs are arranged in a linear array subassembly within each of the waveguides and are designed to have a broadband frequency response by progressively increasing in frequency so that half power points of contiguous cavity pairs are in close proximity.

11 Claims, 4 Drawing Figures

BROADBAND MULTIPACTOR DEVICE

The invention described herein may be manufactured and used by or for the Government for governmental purposes without the payment of any royalties thereon or therefor.

FIELD OF THE INVENTION

This invention relates generally to high frequency electronic devices and more particularly to microwave or millimeter wave devices operating in accordance with the secondary electron resonance phenomenon known as multipactor.

BACKGROUND OF THE INVENTION

The principle of multipactoring caused by secondary electron multiplier action is well known, having been described as early as 1954 in the April issue of the *Journal of Applied Physics,* by A. J. Hatch and H. B. Williams, in an article entitled, "Secondary Electron Resonance". This phenomenon occurs when the coefficient of secondary electron emission between two opposed surfaces across which a cycling voltage is maintained, exceeds unity. Furthermore, if one of the opposed surfaces is perforated, the electrons that are allowed to escape constitute a useful beam current. Additionally, due to the resonant nature of the multipactor process, the output beam will be bunched and thus a non-thermionic electron source becomes available for many applications such as signal amplification . A more recent publication describing the multipactor effect comprises an article entitled, "The Multipactor Effect", which was published by W. J. Gallagher in the *IEEE Transactions On Nuclear Science,* Vol. NS-26, No. 3, June, 1979, pp. 4230–4232.

One known microwave amplifier using multipaction to produce periodically bunched electrons is U.S. Pat No. 3,312,857, which issued to P. T. Farnsworth, on Apr. 4, 1967. The invention described there discloses an electron discharge device comprising a cavity having two spaced apart field defining and electron-emitting surfaces with means for applying an alternating electromagnetic field to the space between the surfaces. The spacing between the surfaces and the amplitude and period of the field are such as to produce phase focusing of electrons in the space between the surfaces. One of the surfaces has an electron emitting aperture from which bunches of phase-focussed electrons are emitted. The device also includes a means for accelerating and directing electron bunches periodically emitted from the aperture along a predetermined path as well as means for absorbing the kinetic energy from the bunches as they traverse a predetermined drift region.

An RF activated, non-thermionic electron gun employing the principles of multipactor is further disclosed in a publication entitled, "The Multipactor Electron Gun", by William J. Gallagher, which appeared in the *Proceedings of The IEEE* on January, 1969, at pp. 94–95.

Accordingly, it is an object of the present invention to provide an improvement in high frequency electronic devices.

It is another object of the invention to provide an improvement in non-thermionic electron devices.

It is yet another object of the invention to provide an improvement in devices operating in accordance with the phenomenon of secondary electron resonance.

It is still another object of the invention to provide improvement in multipactor type devices for use with microwave or millimeter wave signals.

SUMMARY

Briefly, the foregoing as well as other objects of the invention are provided by a multipactor beam device comprised of a plurality of contiguous pairs of RF cavities consisting of an input cavity and an output cavity, having mutually opposed apertures or electron sieves separated by a drift region, across which is applied a DC accelerating potential. The contiguous cavity pairs are formed in a linear array subassembly in two sections of a rectangular waveguide forming thereby an input ridge waveguide section and an output ridge waveguide section. The entire assembly is placed under a vacuum by the inclusion of closure means at both ends of the waveguide sections which additionally include means such as an RF window at one end for coupling RF energy in and out of the waveguide sections while at the other end there is located a solid termination element. The cavity pairs are further designed to respond to progressively increasing frequencies along the linear array so as to provide a relatively wide bandwidth.

DETAILED DESCRIPTION OF THE PREFERRED EMBODIMENT

Figure 1:
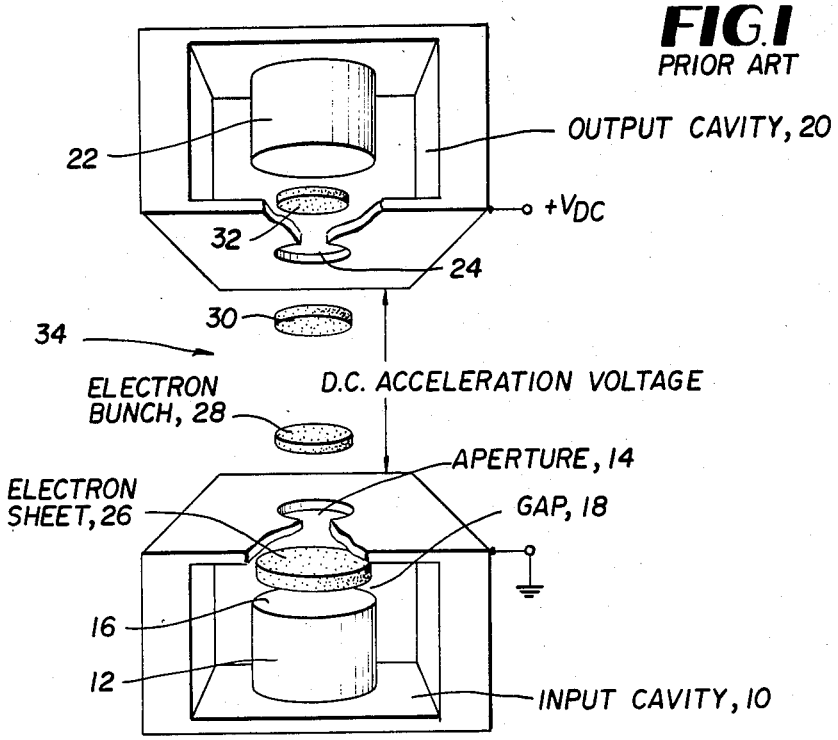
FIG. 1 PRIOR ART
FIG. 1 is a perspective view of a structure embodying a multipactor beam device of the known prior art.

As is well known, under suitable boundary conditions disclosed, for example, by W. J. Gallagher in the aforementioned article, entitled, "The Multipactor Effect", a post loaded reentrant RF cavity configuration such as shown in FIG. 1, can produce an oscillating electron sheet when the cavity is excited by RF energy. Referring now to FIG. 1, reference numeral 10 designates a driver input cavity which additionally includes an internal cylindrical multipactor post 12 centrally located therein beneath a circular aperture 14, often referred to as an electron beam sieve. The separation between the top surface 16 of the multipactor post 12 and the aperture 14 comprises a multipactor gap region 18. The inner surfaces of the cavity 10 and the outer surfaces of the multipactor post 12, moreover, are comprised of silver or copper which exhibit secondary emission properties. When desirable, however, gold, platinum as well as magnesia-gold-cermets or other secondary emitting materials can be used.

In addition to the input cavity 10, the multipactor device shown in FIG. 1 includes an output cavity 20 of substantially the same construction as the input cavity, in that it also includes a cylindrical post 22 located adjacent the circular aperture 24. The two apertures 14 and 24, moreover, are in substantial alignment.

Accordingly, when the input cavity 10 is excited by RF energy, an oscillating electron sheet 26 is formed in the gap region 18 between the post 12 and aperture 14. The electron sheet 26 is highly bunched, giving rise to the term "bunch formation gap" of the region 18 and oscillates back and forth in the gap region 18 at the fundamental frequency of the RF drive excitation. The circular aperture 14 permits electron bunches 28, 30 and 32, for example, from the oscillating sheet 26 to periodically escape from the driver input cavity 10. One electron bunch is produced every RF cycle, and each bunch, when viewed from the plane of the aperture 14, represents a pulse of unidirectional RF current. Thus RF energy which excites the cavity 10 is converted into electron beam energy. The electron bunches 28, 30 and 32 are accelerated through a constant electric field drift region 34 by a high voltage DC potential $V_{dc}$ connected between the cavities 10 and 20. As the electron bunches traverse the drift region 34, they gain kinetic energy which by virtue of the sharp, discrete, nature of the bunches is converted into amplified RF output energy as the bunches are coupled to the internal electric fields of the reentrant output cavity 20. This electron bunching process in an RF driven gap is a special case of the secondary electron resonance phenomenon and builds up whenever boundary conditions in the bunch formation gap 18 are such that electrons can traverse the gap in approximately one half cycle and can strike the opposite gap face with sufficient energy to liberate the secondary electrons.

The multipactor structure shown in FIG. 1 is illustrative of a known prior art basic cavity pair and is inherently narrow band, typically on the order of one half percent, due to the fact that both the driver input cavity 10 and the amplified output cavity 20 exhibit the same single frequency response.

Figure 2:
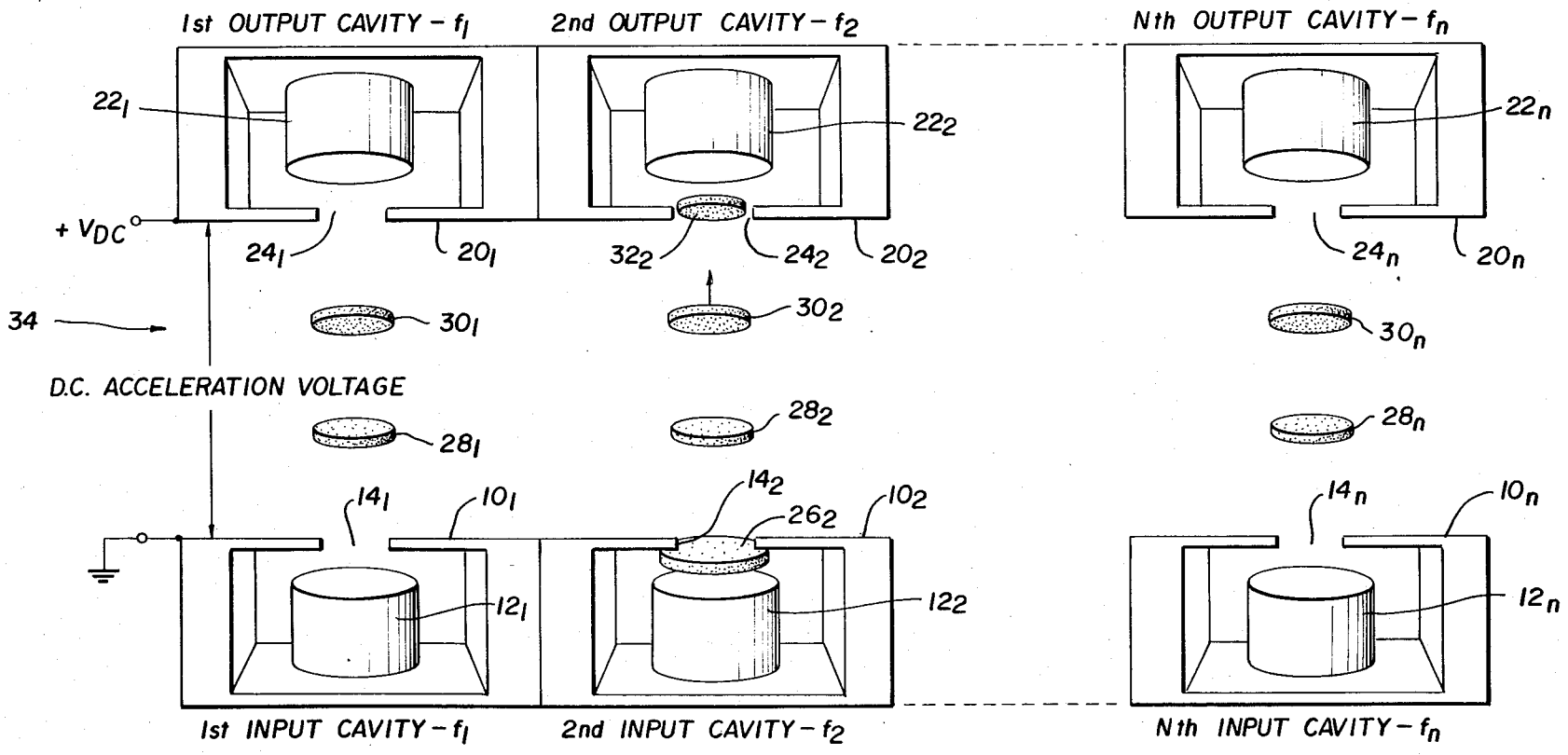
FIG. 2 is a schematic drawing of a linear cavity pair of array subassemblies illustrating the inventive concept of the subject invention.

Referring now to FIG. 2, the present invention has for its purpose iterating the cavity pair structure of FIG. 1 into an additive, composite multiple pair cavity configuration having comparatively broad bandwidth. FIG. 2 is intended to illustrate this concept by the utilization of n cavity pairs, each comprised of input cavities $10_1$, $10_2$ . . . $10_n$ and output cavities $20_1$, $20_2$ . . . $20_n$. Further as shown, the cavity pairs are contiguously joined together so as to share a common drift space 34 and a common DC acceleration voltage $V_{dc}$. Cavity pairs, moreover, are designed to respectively respond to increasing frequencies $f_1$, $f_2$, . . . $f_n$ proceeding from left to right so that respective half power points (3db) of mutually adjacent cavity pairs are in close proximity. By choosing the proper number of cavity pairs it is possible to obtain an arbitrarily broad bandwidth.

Figure 4:
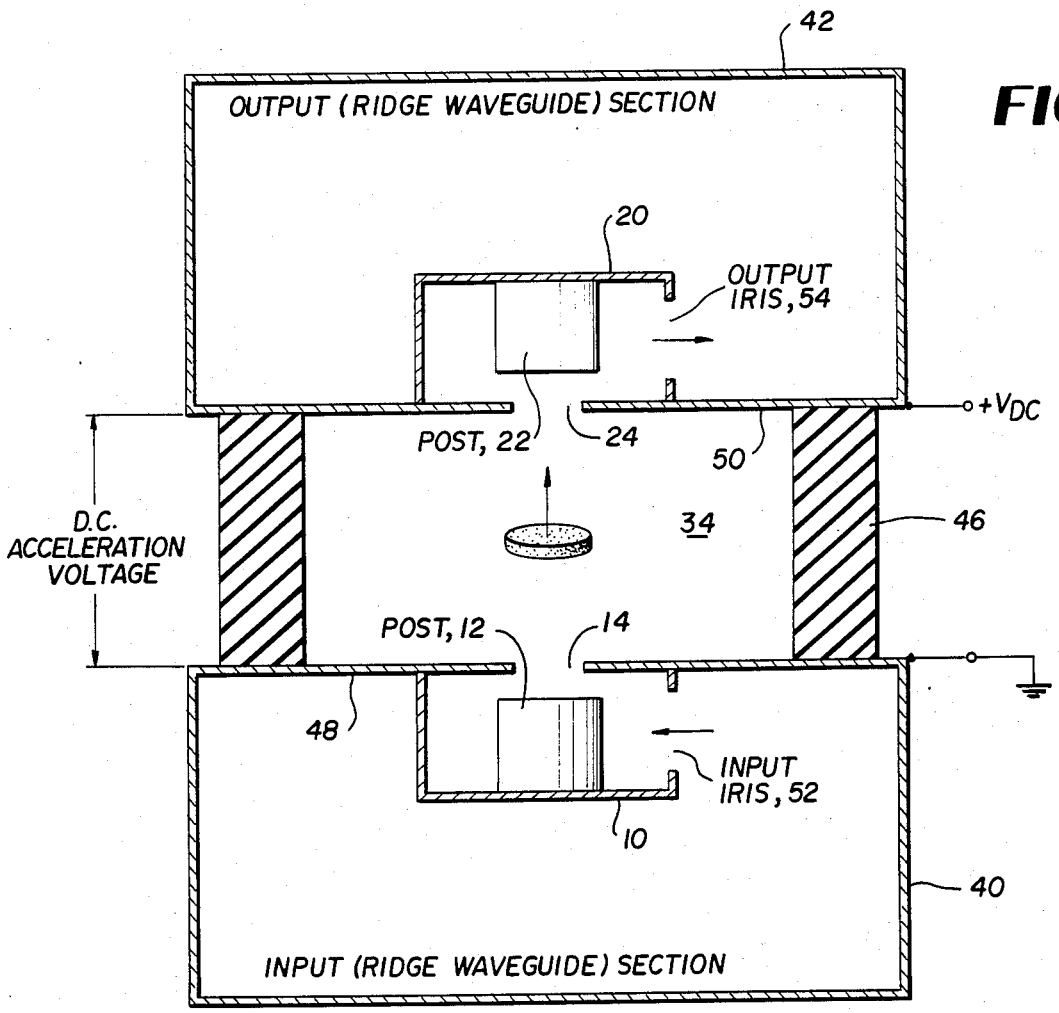
FIG. 4 is a transverse section of the embodiment shown in FIG. 3 and taken along the lines 4—4 thereof.
Figure 3:
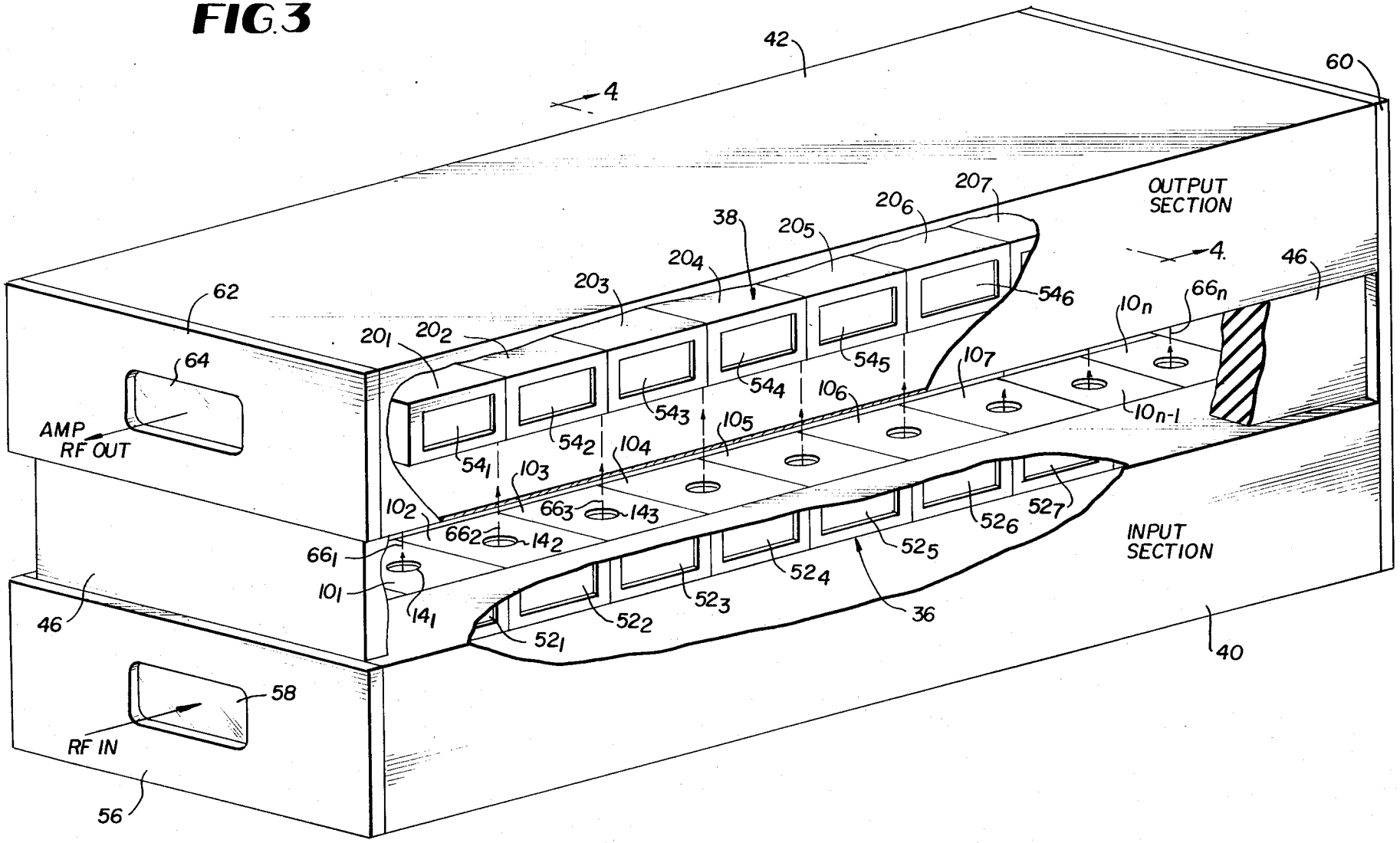
FIG. 3 is a perspective view partially in section of the preferred embodiment of the subject invention.

Proceeding now to FIGS. 3 and 4, shown therein is a ridge waveguide embodiment wherein input and output cavity arrays 36 and 38 form ridge subassemblies in two sections of rectangular waveguide 40 and 42. The waveguide sections 40 and 42 are separated by insulator material 46 specifically dimensioned to provide a common electron bunch drift space 34 across which is coupled a DC acceleration voltage $V_{dc}$ as shown in FIG. 4. The input cavity array subassembly 36 is formed in the upper broad wall 48 of the input waveguide section 40 which additionally includes the input cavity apertures $14_1$ . . . $14_n$ while the lower broad wall 50 of the output waveguide section 42 is used to form the array 38 of output cavities $20_1$ . . . $20_n$ and includes the respective cavity apertures $24_1$ . . . $24_n$. Additionally, the cavity pairs $10_1$ . . . $10_n$ and $20_1$ . . . $20_n$ include respective input irises $52_1$ . . . $52_n$ and output irises $54_1$ . . . $54_n$.

In order that the entire assembly can be placed under a vacuum in order to properly function, the near end of the input waveguide section 40 as shown in FIG. 3 is covered by a termination plate 56 which also includes an RF window 58 and through which RF input power can be coupled into the interior of the waveguide section 40 and into the various input cavities $10_1$ . . . $10_n$ through their respective input irises $52_1$ . . . $52_n$. When desirable, coupling loops or probes can be used in place of the RF window 58. The opposite or far end of the input waveguide section 40 is closed off by a solid termination plate 60 which is also common to the far end of the output waveguide section 42. The near end of the output waveguide section 42 is terminated in an end plate 62 which includes an RF output window 64. As in FIG. 2, the cavity pairs of the structure shown in FIGS. 3 and 4 have increasing frequencies proceeding from the first to the nth stage with the half power points of neighboring cavities being in relatively close proximity so that a composite bandwidth of unprecedented magnitude results.

Since the electron bunching takes place in the active high field gap regions of the input/output cavity pairs, the drift region 34 does not require extensive, relatively heavy and cumbersome magnetic focusing fields such as used in connection with a traveling wave tube or a klystron where focusing magnets account for roughly 30% of the tube cost and about 60% of the tube's volume and weight. Moreover, no elaborate alignment of the cavity beam is required over a relatively long drift space. The only requirement is that the two sets of closely spaced apertures for each cavity pair be aligned. This obtains because each cavity pair operates with its own electron beam as shown by the electron bunch paths $66_1$ . . . $66_n$ of FIG. 3. Further, since the bunched electron beam is RF generated, no costly, cumbersome, complicated electron gun with a thermionic cathode is required. Typically, a broadband amplifier device as shown in FIGS. 3 and 4 can provide a gain of more than 10db with DC voltages in the order of 20 kilovolts. Peak power levels of approximately 100 watts concurrent with bandwidths of 25% or better are readily achievable at 100 GHz when utilizing the configuration shown in FIG. 3 having 50 cavity pairs or more. Correspondingly higher bandwidth and power can be obtained at lower frequencies.

Thus what has been shown and described is a multiple cavity pair structure comprised of contiguous cavity pairs responsive to different frequencies to provide a structure having a relatively wide composite bandwidth.

Having thus shown and described what is at present considered to be the preferred embodiment of the invention, it is to be understood that the foregoing detailed description has been made by way of illustration and not limitation. Accordingly, all modifications, alterations, changes coming within the spirit and scope of the invention as set forth in the appended claims are herein meant to be included.

I claim:

1. An electronic device operable in the microwave millimeter wave frequency range comprising, in combination:

microwave/millimeter wave transmission means;

an array of closly spaced multipactor cavity pairs consisting of input cavities and output cavities arranged in opposed relationship on opposite sides of a DC electric field region coextending longitudinally with said transmission line means;

aligned apertures connecting each cavity pair to said DC electric field region;

an input RF coupling iris and an outut RF coupling iris operably disposed on each of said cavity pairs;

each cavity pair tuned to a respective resonant frequency corresponding to its said input and output coupling irises, the respective resonent frequencies of the cavity pairs varying from pair to pair in the array along said transmission line means.

2. The device as defined by claim 1 wherein said first and second linear arrays are comprised of contiguous multipactor cavities.

3. The electronic device as defined by claim 1 wherein said cavities operate at frequencies which progressively vary from one end to the other and wherein the half power points of adjacent cavity pairs are at relatively close proximity to one another.

4. The electronic device as defined by claim 3 wherein said frequencies progressively increase from one end to the other.

5. The electronic device as defined by claim 3 wherein said transmission line means comprises first and second sections of waveguide.

6. The electronic device as defined by claim 5 wherein said first array of input cavities is located in said first waveguide section forming an input ridge waveguide section and wherein said second linear array of output cavities is located in said second waveguide section forming an output ridge waveguide section.

7. The electronic device as defined by claim 6 wherein said input ridge waveguide section and said output ridge waveguide section are spaced apart a predetermined distance by electrical insulator means for providing a common DC field region for said plurality of multipactor cavity pairs.

8. The electronic device as defined by claim 7 and additionally including means for operating said device in a vacuum.

9. The electronic device as defined by claim 7 and additionally including means for terminating each end of said input and output waveguide sections and means in one end of said input waveguide section for coupling RF energy into said device and means in one end of said output waveguide section for coupling RF energy out of said device.

10. The electronic device as defined by claim 9 wherein said terminating means additionally includes means for evacuating said device.

11. The electronic device as defined by claim 10 wherein said input and output means is selectively comprised of RF windows, coupling loops or coupling probes.

* * * * *